United States Patent [19]

Bowen

[11] Patent Number: 4,498,668

[45] Date of Patent: Feb. 12, 1985

[54] SCORE KEEPING DEVICE

[76] Inventor: Jack Bowen, 939 Rays Rd., Stone Mountain, Ga. 30083

[21] Appl. No.: 593,694

[22] Filed: Mar. 26, 1984

[51] Int. Cl.[3] ..... A63B 49/00

[52] U.S. Cl. ..... 273/73 R; 116/225; 116/324; 273/DIG. 26

[58] Field of Search ..... 116/225, 306, 307, 322, 116/323, 324; 235/1 B, 123; 273/29, 73 R, 73 J, 162 A, DIG. 26

[56] References Cited

U.S. PATENT DOCUMENTS

| | | | |
|---|---|---|---|
| 1,778,737 | 10/1930 | Szepesi | 116/323 |
| 1,880,089 | 9/1932 | Heidecorn | 116/323 |
| 2,402,525 | 6/1946 | Hathaway | 235/123 |
| 4,132,187 | 1/1979 | Moebius | 116/225 |
| 4,189,143 | 2/1980 | Van Auken | 273/73 R |

*Primary Examiner*—Harland S. Skogquist

*Attorney, Agent, or Firm*—Harry I. Leon; V. L. Leon

[57] ABSTRACT

A device for scoring the opposing sides of a tennis match which is adapted to be mounted on the side of a tennis racket handle. A variation of this device may be employed to keep count of the games won by each side. The device comprises an elongated, flexible, transparent structure which is segmented into two compartments by a seam across its mid section. Enclosed within each compartment is a bead-like chip or marker which is slideably movable therein when the marker is pressed gently. Each chip is held in place by a spring-like action wedging it against the wall of its compartment and preventing it from being moved inadvertently during the game. The structure itself is sandwiched between two strips of film which are adhesively attached together. The outer film layer includes an elongated transparent panel through which each marker may be viewed within its compartment and upon which are imprinted indicia, each of which corresponds to a score in a tennis game. The markers are movable to positions beneath these indicia which represent the tennis scoring points "love", "15", "30" and "40". When a marker is slid beneath a particular indicia, that marking stands out from its background so that the score can be easily read. Otherwise, the indicia above each compartment and the layer of film disposed beneath it are difficult to distinguish visually from each other.

10 Claims, 7 Drawing Figures

Fig. 1.
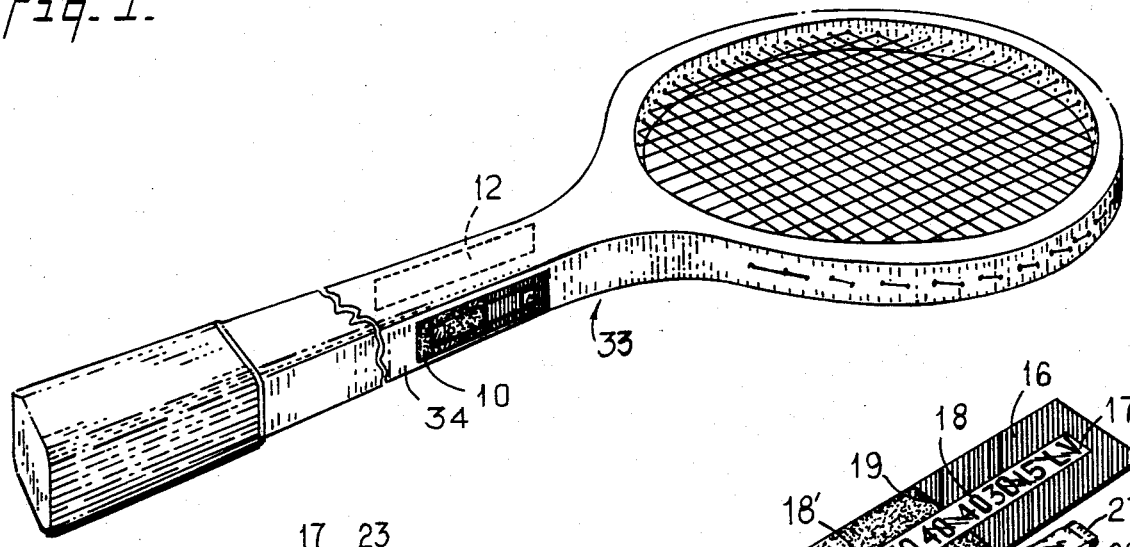
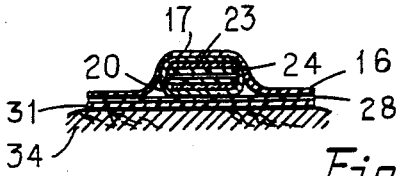
Fig. 3.
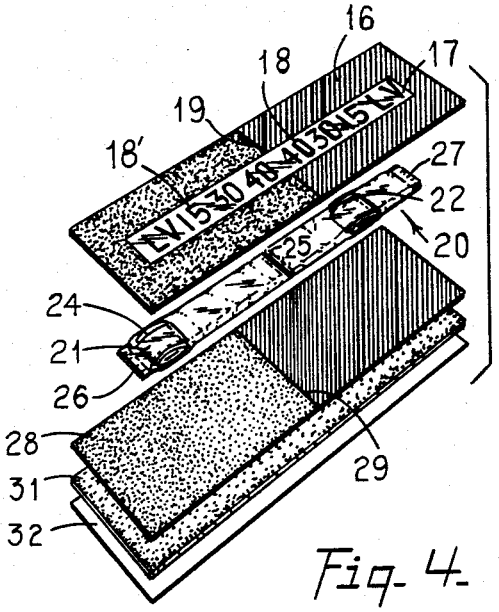
Fig. 4.
Fig. 2.
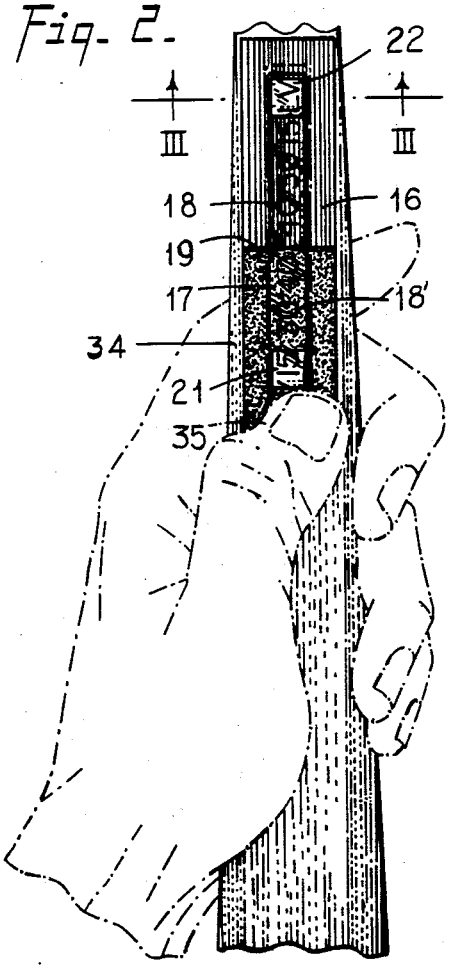
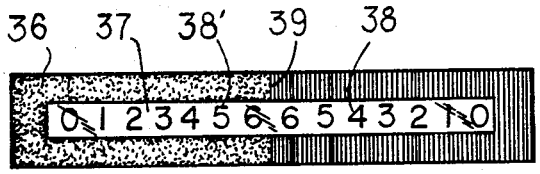
Fig. 5.
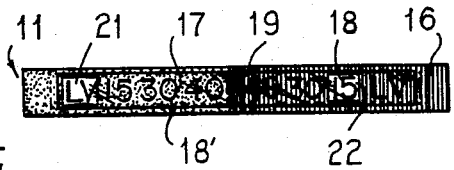
Fig. 6.
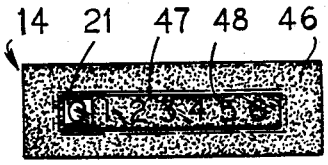
Fig. 7.

SCORE KEEPING DEVICE

BACKGROUND OF THE INVENTION

The present invention relates generally to devices for scoring tennis games and the like and particularly to such devices in which the score is registered by the position of an indicator element which is movable manually along a linear channel.

Score keeping devices with generally linear but open channels along each of which an indicator element can be slid to register a score have been described in the prior art. In U.S. Pat. No. 2,402,525, a scoring device with a plurality of such channels or slots is provided. The opposing sides of each slot have a series of pairs of spaced indentations formed therein for holding an indicator button in a desired location. To change position from one pair of indentations to the next, the user must force the button against the walls of the slot causing them to give slightly.

A variation in which the walls of such a slot are kept parallel to each other in order to facilitate the retention of an indicator element is disclosed in U.S. Pat. No. 4,172,595. There a tennis tally has specially structured marker pins for scoring the opposing sides of a tennis match which are snapped into engagement with the walls of either of two parallel slots. Cylindrical protrusions arrayed parallel to the slots and between them are situated so that these protrusions can interfere with the movement of the marker pins along the slots and hold each of them in position against accidental dislodgement. The bulkiness of this tennis tally dictates that it be mounted on the bottom end of a .cp10 tennis racket handle to mimimize any effect of its air resistance on the user's game.

SUMMARY OF THE INVENTION

It is the object of this invention to provide an improved scoring device that may be used in a games such as tennis and golf. The device comprises at least one marker that is totally enclosed and slideable within an elongated, flexible structure providing a void space such as a tube, the ends of which are sealed. Each marker is a bead-like chip so designed that it has a tendency to spring back and exert a force on the tube wall, once pressure on it has been released thereby enabling the chip to hold its position in the tube. Each marker can be moved in the tube by gently squeezing the tube behind the marker or by pressing directly thereon with the tip of a finger or thumb. There is no need for either indentations or bulky protrusions along a channel to position a marker along a channel in the score keeping device according to the present invention. Hence, it can be made very small and thin in profile and mounted in a conveniently accessible position on a racket handle without significantly effecting the air resistance or balance of the racket.

The position of each marker may be viewed through a transparent section in the tube upon which are superimposed colored indicia corresponding to one side's or an individual player's point score in a game. For tennis, these indicia represent the scoring points "love", "15", "30", and "40". Alternately, the indicia may signal the number of tennis games a side has won or the number of strokes that were needed by a golfer to play a hole. The colors of the indicia and of a material underlying the transparent section of the tube match each other, obscuring the indicia except when a marker, which is of a contrasting color, is situated beneath one of them. The presence of a marker under a particular indicia makes it stand out from its background so that it can be easily read.

For displaying the status of the opposing sides in a tennis match, an elongated, flexible tube which is segmented into two compartments, each of which totally encloses a marker which is viewable through a transparent section of its compartment is provided. Indicia which are superimposed above one of the compartments correspond to one side's score and indicia above the other compartment to the opposing side's score. The colors of the indicia and of a material underlying the transparent section of each compartment match each other, but the colors associated with the two compartments are different to aid in distinguishing between the scores of the two opposing sides of a match.

A still further object is to provide a plurality of score keeping devices which are adapted to be detachably mounted on clothing or the like, so that once such a device has been employed to record the number of strokes made by an individual golfer in playing a hole, the device can be transferred to another site where the number of strokes recorded on the device are then added to the player's overall score.

BRIEF DESCRIPTION OF THE DRAWINGS

Further details are explained below with the help of the examples illustrated in the attached drawings in which:

FIG. 1 is a perspective view of the score keeping device according to the present invention mounted on a tennis racket;

FIG. 2 is a fragmentary plan view of the score keeping device according to FIG. 1 showing the slideable marker as it is being moved within the device by the application of thumb tip pressure;

FIG. 3 is a cross-section III—III from FIG. 2 on an enlarged scale:

FIG. 4 is a exploded view showing in perspective several parts of the score keeping device according to FIG. 1 and a removable protective backing;

FIG. 5 is a plan view of a modification of the uppermost film layer shown in FIG. 4 in which the indicia correspond to the number of games won by each side;

FIG. 6 is a plan view of an alternate embodiment of the score keeping device according to FIG. 1 which is adapted to be mounted within a groove on the handle of a tennis racket; and FIG. 7 is a plan view of a further alternate embodiment of the score keeping device according to the present invention in which the indicia correspond to the number of strokes played by an individual golfer for a particular hole of a golf game.

DESCRIPTION OF THE PREFERRED EMBODIMENT

Referring to FIG. 1 of the drawings, an score keeping device 10 is shown mounted on the handle 34 near the head of a tennis racket 33. In the device 10, there is provided a transparent, flexible structure 20 formed of vinyl or the like. The structure 20 may be made from an rectangular section of plastic sheet which is folded lengthwise so that the opposing edges of the section overlap or, alternately, from a piece of tubing. In either case, the inner wall of the structure 20 is joined to itself preferably by heat sealing near its mid section along a seam 25, thereby dividing the structure into two compartments. As is shown in FIGS. 1, 2, and 4, these compartments hold one bead-like chip or marker 21, 22 apiece. To enclose the markers 21, 22 within their respective compartments, the ends 26, 27 thereof are joined together, also preferably by heat sealing; and the structure 20 is then affixed by adhesive to a support member 28 made from plastic, paper, or a composite thereof.

In the preferred embodiment illustrated in FIGS. 1–4, the support member 28 is an elongated strip of plastic film having imprinted or otherwise displayed thereon two regions of substantially equal area. These regions lie on either side of a line 29 and are distinguishable from each other by their color. Alternately, they may be distinguishable because of their pattern. When the seam 25 in the structure 20 is aligned parallel to and disposed contiguous the line 29 in the support member 28 as shown in FIG. 1, and 2, each compartment of the structure is situated above a differently colored region of the support member.

As is best seen in FIG. 4, the structure 20 is sandwiched between the support member 28 and an overlying member 16 adhesively attached thereto. The member 16 is preferably a strip of plastic film, a portion of which defines an elongated transparent panel 17. The panel 17 has approximately the same dimensions in length and width as does the structure 20 when it is affixed to the member 28 so that the markers 21, 22 can be viewed within their individual compartments.

As illustrated in FIGS. 2 and 4, indicia 18′ are imprinted in the sequence "LV", "15", "30", and "40" on the panel 17 above one of the compartments; above the other, indicia 18 colored differently than the indicia 18′ appear in the reverse order of this sequence. The color of the indicia 18, 18′ matches the color of that region of the support member 28 which is contiguous thereto, so that the indicia 18, 18′ tend to be obscured by the coloration of the material underlying their respective compartments. Moreover, the colors of that portion of the overlying member 16 situated on the same side of the line 19 and of the indicia similarly located are preferably identical. The markers 21, 22, on the other hand, are of contrasting color to the indicia 18, 18′. Further, the width of each marker 21, 22 in a direction parallel to the longitudinal axis of the structure 20 is slightly larger than the greatest dimension of each of the indicia 18, 18′ on the panel 17. Thus when a marker 21, 22, is slid beneath a particular indicia, that marking stands out from its background, making the status of a tennis match observable to a player at a glance.

FIG. 5 illustrates an overlying member 36 similar to the member 16, having a transparent panel 37 on which are imprinted indicia 38, 38′ to register the number of tennis games each opposing side has won. Preferably, the indicia 38, 38′ have the same color as the indicia 18, 18′, respectively. Further, the colors of that portion of the overlying member 36 situated on the same side of the line 39 and of the indicia similarly located are preferably identical. The overlying member 36 is part of a score keeping device 12 (FIG. 1) which includes a transparent structure which is an elongated version of the structure 20 and which is also segmented into two compartments, each of which encloses a marker 21, 22. Like the device 10, the structure in the device 12 is sandwiched between the overlying member 36 and a support member having two regions of equal area, each region being of the same color as the indicia 38, 38′ beneath which it is disposed. Thus the indicia 38, 38′ are also obscured except when a marker is situated beneath one of them.

Alternately, the score keeping device may comprise a structure 20 filled with a fluid such as a jelly (not shown) colored to match the indicia 18, 18′ superimposed above its compartment. When the jelly is pressed out of the way, a material underlying the compartment contiguous that particular indicia and of a contrasting color to it is revealed.

A further variation includes a score keeping device with indicia in the form of raised letters (not shown) which are obscured by an overlying coated film except when the film is pressed against one of these letters. The image of the letter on the film is erased by pressing on another section of the film, utilizing a mechanism similar to that employed in lifting "magic" letters from a well known children's toy.

In the preferred embodiments illustrated in the drawings, the markers 21, 22 each comprise an insert 24 which is a section of a plastic drinking straw of a contrasting color to the indicia 18, 18′ 38, 38′ and of a more resilient material than the structure 20. Preferably a sheath 23 formed of transparent plastic tubing similar to that of the structure 20 is provided for insert 24. The overall dimension of the markers 21, 22 is such that the transverse width of each in a direction perpendicular to the longitudinal axis of the structure 20 is sufficiently large to prevent the accidental dislodgement of the marker but still small enough to allow it to be easily propelled along the tube when pressure from the tip of a thumb or finger is applied to one side or the other of a marker. Alternately, a marker 21, 22 may be formed of a piece of suitably colored foam such as STYROFOAM, of rubber, or of a like material which is both slideable within the structure 20 and which is of sufficient size and compressibility to exhibit a spring-like action to wedge the marker 21, 22 against the structure once finger force on the marker is released. A tiny amount of a highly viscous, clear oil may be applied to the surface of each marker 21, 22 prior to enclosing it within its respective compartment to enhance its slideability therein. Such lubrication was found not to be essential, however, when a sheath 23 is employed.

In operation, the markers, 21, 22 tend to move in spurts as pressure is applied to one side or the other of them. Two applications of thumb or finger tip pressure may be required to position the marker accurately under a indicia. Alternately, the marker can be moved by a rolling motion of the thumb or finger tip gently squeezing the structure behind the marker or sliding the finger across the transparent panel to push the marker along.

In the preferred embodiment illustrated in FIGS. 1 through 4, the support member 28 is attached with the use of a double adhesive tape 31, following the removal of its protective backing 32, to a side of the racket handle 34. The orientation of the device 10 on the racket handle is preferably such that the color selected to represent a particular contestant in a match is closest to the hand grip of that player's racket.

An embodiment which is designed to be mounted within a groove (not shown) on a racket handle is a score keeping device 11 which includes the overlying member 16, the indicia 18, 18′, the structure 20, the markers 21, 22 and a support member 28 (FIG. 6). A modification of the device 11 utilizes the overlying member 36 with its indicia 38 shown in FIG. 5. In the device 11, portions of the member 16 on either side of the panel 17 are folded under and secured to each other and to one or more layers depending upon the depth of the groove, of a double adhesive tape (not shown). The device 11 is then positioned in the groove so that the upper surface of the panel 17 is at least even with the outer sides of the groove to facilitate manipulation of the markers 21, 22.

A further embodiment utilizes markers 21, 22 which are as large as tennis balls (not shown) in score keeping devices 10, 12 which, resembling scoreboards, are sized to be read by spectators viewing a tennis tournament.

For golfers there is provided a score keeping device 14 shown in FIG. 7 which includes an overlying member 46 with a transparent panel 47 on which are imprinted indicia 48 to record the number of strokes played by an individual for a particular hole in a golf game. A single marker 21 is enclosed in a transparent structure which, resembling a compartment of the structure 20, is sandwiched between the overlying member 46 and a support member which is of the same color as the indicia 48. When the marker 21 is slid beneath one of the indicia, that particular marking stands out. Otherwise, the indicia 48 are obscured by their background coloration.

The device 14 is preferably secured to a material having means for detachably mounting it on clothing such as one face of a Velcro fastener. In use each golfer carries eighteen devices 14 with him on the course on a pad preferably covered with the mating face of the Velcro type fastener. He then transfers one of the devices 14 to a convenient site such as a shirt sleeve or a sweat band when he is ready to record each stroke at a particular hole. Afterwards the device 14 is returned to the pad or another suitable site where the number of strokes recorded on the device may be added to the player's overall total for the game.

Although several embodiments of the invention have been illustrated in the accompanying drawings and described in the foregoing detailed description, it will be understood that the invention is not limited to the embodiments disclosed, but is capable of numerous rearrangements, modifications and substitutions without departing from the scope of the invention.

What is claimed is:

1. Score keeping device comprising:

(a) an elongated structure of a transparent flexible plastic material on which indicia for scoring a game are superimposed;

(b) at least one marker of a contrasting color to that of the indicia is enclosed and slideable within the structure; and (c) means for holding the score marker in a fixed position relative to the indicia so that it will not move inadvertently during the game.

2. A score keeping device according to claim 1 wherein the marker is a short segment of light-colored, flexible material that fits into said structure; the marker sliding forward easily within the structure when the structure is pinched immediately behind the marker, so that the marker can be readily positioned beneath one of the indicia.

3. A score keeping device according to claim 1 that further comprises means attached to said structure for mounting it in a conveniently accessible position on a tennis racket handle between the head and the hand grip and wherein said structure and said mounting means together present a thin profile, so that the score keeping device does not significantly alter the air resistance and balance of the racket.

4. A score keeping device comprising:

(a) a transparent, flexible plastic tube;

(b) an indicator element that is slideable within said tube;

(c) a support member on which said tube is mounted, the color of each portion of the support member contiguous the tube being in contrast to that of the indicator element; and (d) indicia which are superimposed on said tube and which are of the same color as that portion of the support member to which they are contiguous, so that when the indicator element is positioned under one of the indicia, it can be easily be read while the rest or the indicia not immediately overlying an indicator element blend into the background coloration provided by the support member.

5. A score keeping device according to claim 4 which further comprises:

(a) the tube having two compartments;

(b) one indicator element that is slideable within each compartment; and (c) one of the compartments being mounted upon a first portion of the support member; the other compartment being mounted upon a second portion of the support member; the colors of the first and second portion and of their respective contiguous indicia being distinguishable from each other, thereby facilitating a correspondence between the position of each indicator element in its respective compartment and the score of one of the opposing sides of a match.

6. A score keeping device according to claim 4 wherein the indicator element is further characterized as springing apart once pressure on it is released and which is capable of expanding to and exerting a force against the wall of the tube, so that the indicator element can hold its position in the tube during the course of the game.

7. A score keeping device comprising:

(a) an elongated structure of a flexible material providing a void space and including an elongated transparent section;

(b) means for superimposing indicia on said transparent section with the indicia aligned in generally linear array substantially parallel to the longitudinal axis of the structure;

(c) at least one indicia element of contrasting color to that of the indicia, said element underlying a portion of said transparent section; and (d) means underlying said section for obscuring each of the indicia except the indicia beneath which said element is viewable through said transparent section.

8. A score keeping device according to claim 7 wherein said element further comprises a marker that is enclosed and slideable within said structure, the marker springing apart once pressure on it is released and which is capable of expanding and exerting a force against the wall of the structure, so that the marker can hold its position in the structure during the course of play.

9. A score keeping device according to claim 7 wherein the obscuring means includes a support member on which the structure is mounted and which is viewable in part through the transparent section, the support member having the same color as the indicia, so that when the indicator element is positioned under one of the indicia, it can be easily read while the rest of the indicia not immediately overlying the indicator blends into the background coloration provided by the support member.

10. A score keeping device according to claim 7 which further comprises:

(a) the structure having two compartments;

(b) one indicator element that is slideable within each compartment; and (c) the obscuring means including a support member on which the structure is mounted and which is viewable in part through the transparent section; one of the compartments being mounted upon a first portion of the support member; the other compartment being mounted upon a second portion of the support member; the colors of the first and second portions and their respective contiguous indicia being distinguishable from each other, thereby facilitating a correspondence between the position of each indicator element in its respective compartment and the score of one of the opposing sides of a match.

* * * * *